US005639263A

United States Patent [19]

Zell et al.

[11] Patent Number: 5,639,263

[45] Date of Patent: Jun. 17, 1997

[54] PLUG-TYPE CONNECTOR BETWEEN WIRING BACKPLANES AND ASSEMBLY PRINTED CIRCUIT BOARDS

[75] Inventors: Karl Zell, Niederpoecking; Peter Seidel, Groebenzell, both of Germany

[73] Assignee: Siemens Aktiengesellschaft, Munich, Germany

[21] Appl. No.: 424,056

[22] Filed: Apr. 19, 1995

[30] Foreign Application Priority Data

Apr. 29, 1994 [DE] Germany ..... 44 15 171.3

[51] Int. Cl.[6] ..... H01R 13/648

[52] U.S. Cl. ..... 439/608; 439/108

[58] Field of Search ..... 439/607–610, 439/95, 108, 101, 83

[56] References Cited

U.S. PATENT DOCUMENTS

| | | | |
|---|---|---|---|
| Re. 32,691 | 6/1988 | Dola et al. | 439/608 |
| 4,611,867 | 9/1986 | Ichimura et al. | 439/608 |
| 4,628,652 | 12/1986 | Wefels | 52/306 |
| 4,846,727 | 7/1989 | Glover et al. | 439/608 |
| 5,360,346 | 11/1994 | Regnier | 439/608 |

FOREIGN PATENT DOCUMENTS 0 103 192 6/1986 European Pat. Off. .

*Primary Examiner*—Hien Vu

*Attorney, Agent, or Firm*—Hill, Steadman & Simpson

[57] ABSTRACT

The invention is directed to a plug-type connection composed of blade connector and spring clip, whereby the individual contact passages are surrounded by electrically conductive shielding plates that are connected to shield contactings carrying a ground or shield potential. The shield contactings are to an intermediate shielding grid system located both at the backplane side and at the circuit board or module side. In order to achieve an improved interconnect passage width between the contact blades and the shield contactings arranged in the intermediate grid, the electrical connection between the connector or spring clip and assembly printed circuit board ensues on the basis of pressure of spring-like bent terminal ends which flatten onto contact surfaces on the assembly printed circuit board.

6 Claims, 3 Drawing Sheets

PLUG-TYPE CONNECTOR BETWEEN WIRING BACKPLANES AND ASSEMBLY PRINTED CIRCUIT BOARDS

BACKGROUND OF THE INVENTION

The invention is generally directed to a plug-type connection between a wiring backplane and an assembly printed circuit board. More particularly, the present invention relates to such a connector which is shielded.

A plug-type connector wherein a shielding ensues in an intermediate shielding grid, as recited above, has been disclosed in European Patent Application 94 103 192. Such conventional plug-type connector arrangements partly present the disadvantage that too small an interconnect passage width is established on the printed circuit boards between the contact blades and the shield contactings arranged in the intermediate grid. This results in the fact that the multilayer requires additional layers and thus becomes expensive.

An object of the present invention is therefore comprised in creating a plug-type connection of the species initially cited wherein an adequate interconnect passage width is established and that does not require any expensive multilayers.

SUMMARY OF THE INVENTION

These objects are inventively achieved by providing a plug-type connector for conductively connecting a wiring backplane to a printed circuit board. The connector includes a plurality of conductive shielding plates arranged to form a plurality of receptacle chambers. The shielding plates are connectable to a shield voltage. A plurality of contact springs are provided such that each contact spring is disposed in one of the receptacle chambers and is insulated from the shielding plates. Each contact spring has a blade contact end for contacting the backplane and an opposite terminal end for contacting the printed circuit board. A plurality of shielding plate terminal ends extend from at least some of the shielding plates, and these terminal ends are each bent to form a prestressed portion or spring projection. In an uninstalled condition of the connector, the spring projection terminal ends extend toward the printed circuit board in a bent fashion at an angle or bowed curve. However, in an installed condition of the connector, the terminal ends are contactable against a plurality of corresponding terminal contact surfaces disposed on the printed circuit board to which provide shield voltage. The connector is mechanically secured against the printed circuit board at a plurality of locations so that each terminal end resiliently flattens against the corresponding terminal contact surface.

In an embodiment, terminal extensions of the contact springs are bent to form a biased spring projection in a manner similar to the shield plate terminal ends.

Furthermore, according to an embodiment of the invention, the shielding plate compartment includes transverse shielding plates arranged perpendicularly relative to the assembly printed circuit board which are corrugated. Also, portions of the contact spring parts proceeding perpendicularly relative to the assembly printed circuit board are corrugated. Thus, a continuous predetermined force can be provided against terminal eyelet or contact surface of the circuit board. An advantage of this plug-type connection is that it can be easily dismantled.

In the plug-type connector according to the present invention, contacting generally occurs on the outside surface of the printed circuit board in a surface-mount manner. Thus, the need for a press-in hole is eliminated in creating a desired interconnect or lane guidance on the assembly printed circuit board. Electrical linking to individual layers of multilayered printed circuit board can ensue at any selected location with small changers.

In an embodiment, at the module side, the terminal ends of the shielding plate compartment and the terminal ends of the contact springs are bent over prior to installation against the surface of the printed circuit board or downwardly-extending spring leg or bowed portion. Terminal eyelets or contact surfaces are provided on the assembly printed circuit board in a counter-region contacting against the terminal ends. The terminal ends and the contact surfaces are soldered together. The spring clip is mechanically secured on the assembly printed circuit board at a plurality of locations. An advantage of this is a better electrical connection as a result of the soldering. However, such an embodiment requires unsoldering in order to dismantle the connection.

In an embodiment, the plug-type connector is composed of a blade connector fashioned as a rectangular housing open at one side for plugging onto the blades of a wiring backplane and of a spring clip that can be plugged into the blade connector, provided with receptacle chambers equipped with contact springs, and firmly joined to an assembly printed circuit board, whereby the blades and springs are arranged parallel in a plurality of rows, whereby the individual contact passages are surrounded by electrically conductive shielding plates that are connected to contactings carrying shield potential that are attached in the intermediate grid both at the backplane side as well as at the module side, the contactings being grounded or charged with an appropriate shielding voltage.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
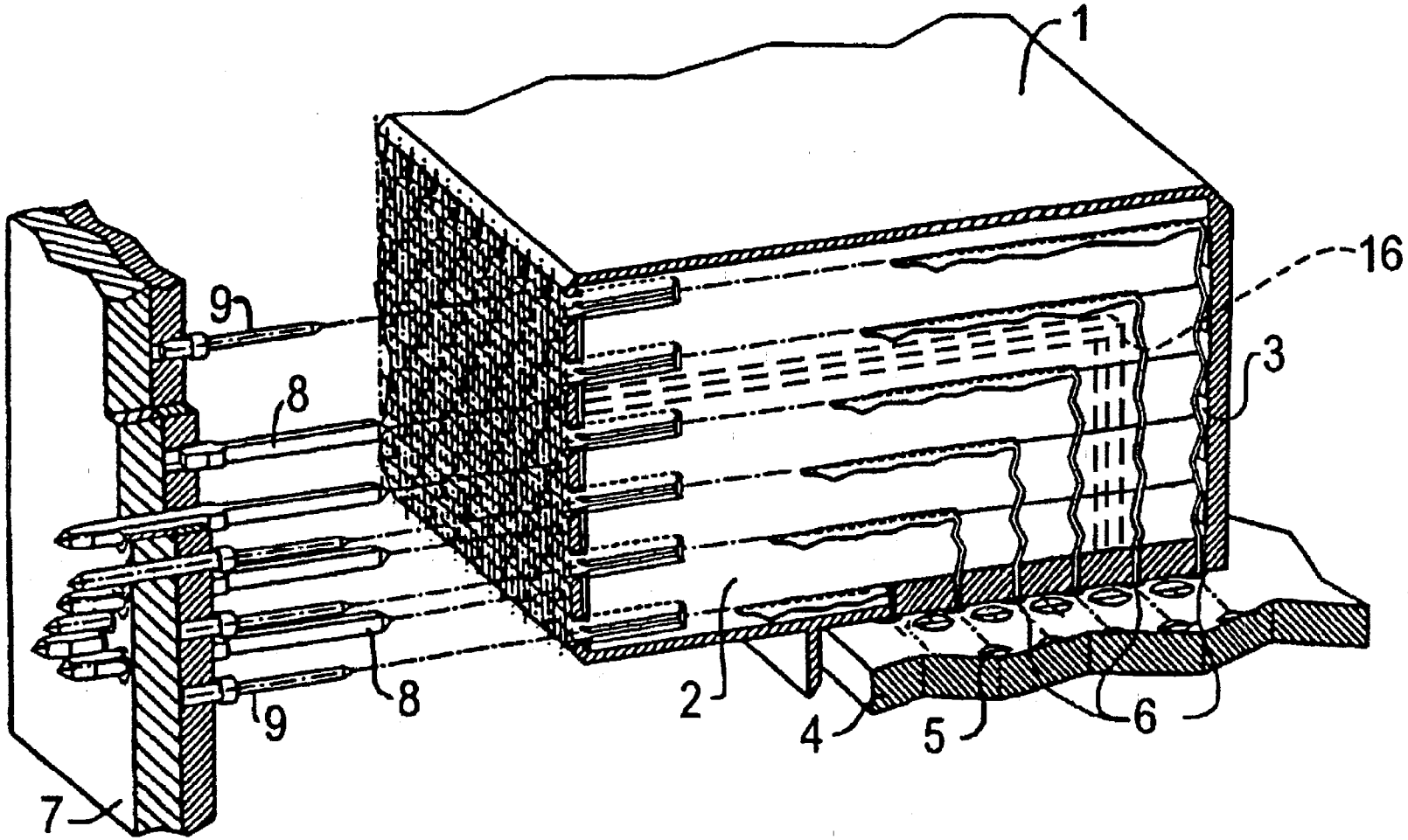
FIG. 1 is a sectional, perspective view of a plug-type connector wherein the contacting to the assembly printed circuit board ensues with pressing power.

The present invention provides a connector or spring clip 1 for electrically connecting between a wiring backplane 7 and a printed circuit board 4. The spring clip 1 includes a shielding plate compartment 2 formed of a plurality of shielding plates arranged together to define a plurality of receptacle chambers.

The spring clip 1 also includes conductive contact springs 16, each of which provides an electrically conductive connection between a contact on the backplane 7 and a corresponding signal contact on the printed circuit board 4. Each contact spring 16 typically has a first end shaped to receive a contact blade from the wiring backplane 7 and a second end or spring contact terminal end which contacts the printed circuit board 4. Each spring contact 16 is disposed in one of the receptacle chambers so that it is generally surrounded by shielding plates, but insulated therefrom.

Figure 3A:
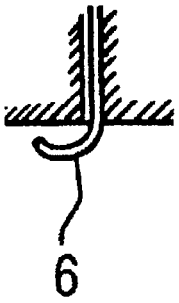
FIG. 3*a* is a side sectional view of a spring-contact shielding plate terminal end having a rounded shape in an uninstalled condition.
Figure 3B:
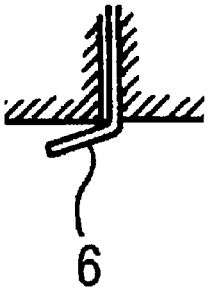
FIG. 3*b* is a sectional side view of a spring-contact shielding plate terminal end having an angled-off straight shape in an uninstalled condition.

The shielding plate compartment 2 of the spring clip 1 includes transverse plates 3 when the spring clip 1 is installed against the circuit board 4 perpendicularly relative to the assembly printed circuit board 4. The transverse plates 3 include terminal ends 6. The terminal ends 6 face the printed circuit board 4 and are generally extensions of the shielding plate; each being bent to form a spring projection. As illustrated in FIGS. 3*a* and 3*b*, in an uninstalled condition, each terminal end 6 is bent away, forming the spring projection or prestressed contact which extends at an angle or bowed curve toward the printed circuit board 4.

Figure 3C:
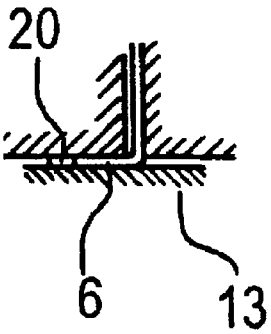
FIG. 3*c* is a sectional view illustrating one of the shielding plate terminal ends in an installed condition against a printed circuit board contact surface and having a soldered connection.

FIG. 3*c* illustrates an installed condition of the connector 1 against the printed circuit board 4. Terminal eyelets or shield contact surfaces 5 are provided on the assembly printed circuit board 4 in the counter-region of the shielding plate terminal ends 6, to receive contact therewith. The contact surfaces 5 provide the grounding or shield voltage to the shielding plate compartment 2. As illustrated, when the connector 1 is pressed toward the printed circuit board 4, the terminal ends 6 each flatten against the corresponding contact surface 5 providing a reliable shielding contact. The contact surfaces 5 as well as the terminal ends 6 can comprise upgraded contact surfaces which, for example, can be gold plated. A low contact resistance is thereby created.

The spring clip 1 (not shown here in the installed condition) is firmly screwed to the assembly printed circuit board 4 or is connected thereto by some other mechanical securing means, such as by a press-in fitting. Such a mechanical securing means provides a securing force of the spring clip against the printed circuit board which overcomes the contact force of the corrugated transverse plates between the terminal ends 6 and the respective contact surfaces.

The contact springs 16 can also be formed with spring projection type contact spring terminal ends similar to the shielding plate terminal ends of the type illustrated in FIG. 3. Such contact spring terminal ends also resiliently flatten in reliable contact against corresponding signal contact surfaces on the printed circuit board 4. Such an embodiment is described below in connection with FIGS. 2, 4*a*, 4*b* and 4*c*.

In the embodiment of FIG. 1, the transverse portions of the shielding plates 6 and transverse portions of the contact springs 17 are preferably corrugated. Such a corrugated configuration, for example, provides rigidity to these components.

Since the contacting occurs against an outside surface of the printed circuit board 4, a conventional press-in hole type of connection is no longer necessary to form an interconnect or lane guidance. The electrical linking to the individual layers of a multilayer circuit board can ensue at any desired location with small changers. Given employment of this solution, the temperature stressing on the signal contact springs 16, as required in the surface mount device (SMD) embodiment set forth below, can be avoided.

The spring clip 1 is also connected to the wiring backplane 7 of a module frame via blades 8 and shield contactings 9.

Figure 2:
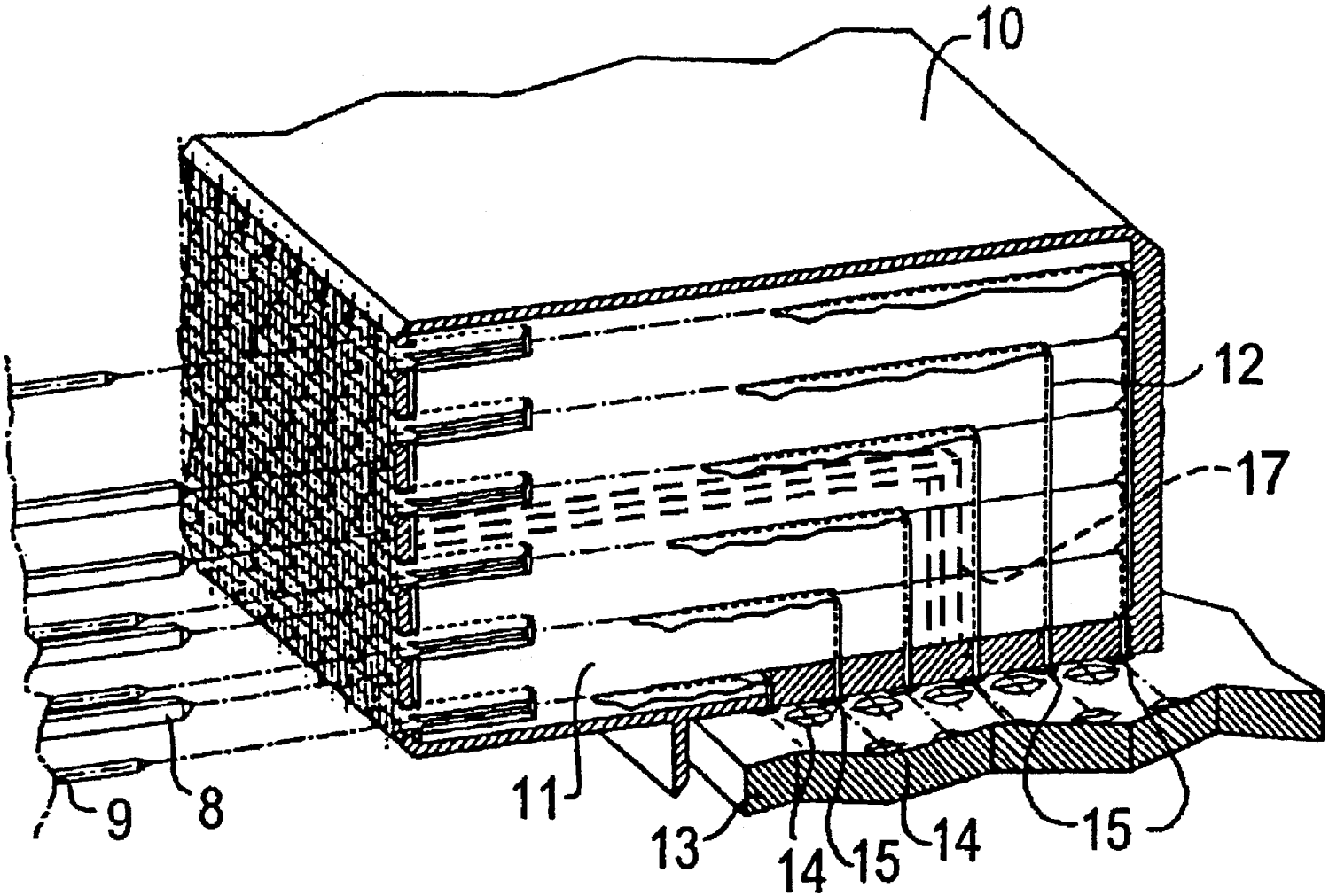
FIG. 2 is a sectional, perspective view of a plug-type connector wherein the contacting to the assembly printed circuit board ensues by soldering.
Figure 4A:
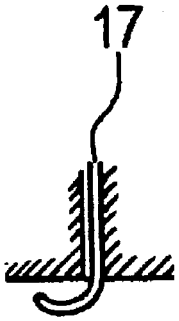
FIG. 4*a* is a side sectional view of a spring-contact signal-carrying contact spring terminal end having a rounded shape in an uninstalled condition.
Figure 4B:
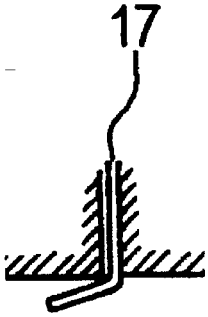
FIG. 4*b* is a sectional side view of a spring-contact signal-carrying contact spring terminal end having an angled-off straight shape in an uninstalled condition.
Figure 4C:
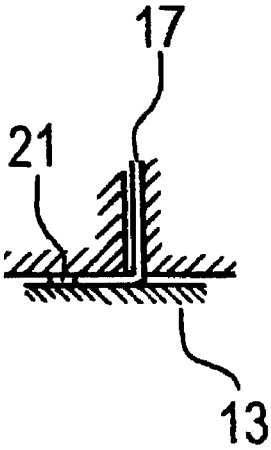
FIG. 4*c* is a sectional view illustrating one of the signal-carrying contact spring terminal ends in an installed condition against a printed circuit board and having a soldered connection.

FIG. 2 shows a spring clip 10 having a shielding plate compartment 11 that comprises transverse plates 12 which shield contact springs 17. This spring clip 10 is firmly joined to the assembly printed circuit board 13. In the embodiment shown in FIG. 2, the connection between the spring clip 10 and the assembly printed circuit board 13 ensues in SMD technique; as illustrated in FIGS. 4*a*, 4*b* and 4*c*, and as explained above wherein the contact spring terminal ends may be shaped as rounded (FIG. 4*a*) or straight (FIG. 4*b*) spring projections to flatten (FIG. 4*c*) against a contact surface on the circuit board 13. Corrugated transverse plates or, respectively, corrugated portions of the contact springs 17 therefore need not be provided in this embodiment. In this embodiment, too, the spring clip 10 is mechanically connected to the assembly printed circuit board 4 in the installed condition. Whether the embodiment of FIG. 1 or FIG. 2 is selected is determined according to whether or not one wishes to avoids subjecting the spring clip to thermal loads, or whether dismantling without unsoldering would be desirable.

The terminal ends may be soldered to the respective contact surfaces, as shown in FIG. 3*c* (shield terminal end) and FIG. 4*c* (signal-carrying contact spring) by a solder bead 20 and 21, respectively.

It should be understood that various changes and modifications to the presently preferred embodiments will be apparent to those skilled in the art. Such changes and modifications may be made without departing from the spirit and scope of the present invention and without diminishing its attendant advantages. Therefore, such changes and modifications are intended to be covered by the appended claims.

What is claimed is:

1. A plug-type connector for conductively connecting a wiring backplane to a printed circuit board, the connector comprising:

a plurality of conductive shielding plates arranged to form a plurality of receptacle chambers, the shielding plates being connectable to a shield voltage;

a plurality of contact springs, each of said contact springs being individually disposed in one of said receptacle chambers and insulated from said shielding plates, each of said receptacle chambers surrounding the respective contact spring substantially along a length of said contact spring, each of said contact springs have a blade contact end for contacting a blade of said backplane and an opposite terminal end for contacting the printed circuit board;

a plurality of shielding plate terminal ends extending from at least some of the shielding plates, said shielding plate terminal ends being bent to form respective spring projections;

wherein the shielding plate terminal ends are contactable against a plurality of corresponding generally flat shield contact surfaces disposed in the printed circuit board to supply shield voltage, and wherein the connector is securable against the printed circuit board at a plurality of locations so that each of said shielding plate terminal ends resiliently flattens against the corresponding flat shield contact surface; and wherein the shielding plate terminal ends are soldered to the shield contact surfaces.

2. The connector according to claim 1 wherein contact spring terminal ends are bent to form a spring projection, and wherein the contact spring terminal ends are contactable against a plurality of corresponding generally flat signal contact surfaces disposed on the printed circuit board so that each of the contact spring terminal ends resiliently flattens against the corresponding signal contact surface.

3. A plug-type connector for conductively connecting a wiring backplane to a printed circuit board, the connector comprising:

a plurality of conductive shielding plates arranged to form a plurality of receptacle chambers, the shielding plates being connectable to a shield voltage;

a plurality of contact springs, each contact spring being individually disposed in one of said receptacle chambers and insulated from said shielding plates, each of said receptacle chambers surrounding the respective contact spring substantially along a length of said contact spring, each contact spring having a blade contact end for contacting a blade of said backplane and an opposite terminal end for contacting the printed circuit board; and a plurality of shielding plate terminal send extending from at least some of the shielding plates, the shielding plate terminal ends being bent to form respective spring projections;

a plurality of contact spring terminal ends extending from said contact springs, the contact spring terminal ends being bent to form respective spring projections which flatten against corresponding generally flat signal contact surfaces on the printed circuit board;

wherein the shielding plate terminal ends are contactable against a plurality of corresponding generally flat shield contact surfaces disposed on the printed circuit board to provide said shield voltage;

wherein the connector is securable against the printed circuit board at a plurality of locations so that each shielding plate terminal end resiliently flattens against the corresponding generally flat shield contact surface; and wherein the shielding plate terminal ends are soldered to the shield contact surfaces.

4. The connector according to claim 1, wherein the receptacle chambers and corresponding contact springs are generally L-shaped.

5. The connector according to claim 3, wherein the receptacle chambers and corresponding contact springs are generally L-shaped.

6. The connector according to claim 3, wherein the contact spring terminal ends are soldered to the signal contact surfaces.

* * * * *